US007140356B2

(12) United States Patent
Kishibata et al.

(10) Patent No.: US 7,140,356 B2
(45) Date of Patent: Nov. 28, 2006

(54) ENGINE THROTTLE OPENING DEGREE AREA ESTIMATION METHOD, AS WELL AS ENGINE ACCELERATION DETECTION METHOD AND DEVICE AND ENGINE FUEL INJECTION CONTROL METHOD AND DEVICE USING THE ESTIMATION METHOD

(75) Inventors: Kazuyoshi Kishibata, Numazu (JP); Yuichi Kitagawa, Numazu (JP); Hiroyasu Sato, Numazu (JP); Tomoaki Sekita, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 105 days.

(21) Appl. No.: 11/065,463

(22) Filed: Feb. 24, 2005

(65) Prior Publication Data

US 2005/0188960 A1 Sep. 1, 2005

(30) Foreign Application Priority Data

Feb. 26, 2004 (JP) ..... 2004-050945

(51) Int. Cl.
*F02D 41/10* (2006.01)
*F02D 41/18* (2006.01)

(52) U.S. Cl. ..... 123/492; 123/399; 123/684

(58) Field of Classification Search ..... 123/492, 123/399, 684
See application file for complete search history.

(56) References Cited

U.S. PATENT DOCUMENTS 4,905,654 A * 3/1990 Katsuno et al. ..... 123/704
5,588,416 A * 12/1996 Suzuki et al. ..... 123/684
5,753,805 A * 5/1998 Maloney ..... 73/118.2
6,363,316 B1 * 3/2002 Soliman et al. ..... 123/399
6,571,767 B1 * 6/2003 Kobayashi et al. ..... 123/399
6,651,492 B1 * 11/2003 Kolmanovsky et al. .... 73/118.2
6,672,060 B1 * 1/2004 Buckland et al. ..... 123/564
6,805,095 B1 * 10/2004 Sun et al. ..... 123/399

FOREIGN PATENT DOCUMENTS

JP 06-074076 * 3/1994
JP 2002-242749 2/2002

* cited by examiner

*Primary Examiner*—Erick R Solis
(74) *Attorney, Agent, or Firm*—Pearne & Gordon LLP

(57) ABSTRACT

An engine fuel injection control device including: means for detecting an amount of change per minimal time in intake pipe pressure of an engine as an intake pipe pressure change amount; means for performing an arithmetical operation of calculating an opening area of an orifice from a relationship between a mass flow rate of gas and the intake pipe pressure change amount in a process for the intake pipe pressure to increase after an intake valve of the engine is closed, the gas flowing through said orifice by a difference in pressure on both sides of the orifice when a throttle valve is regarded as the orifice; and means for estimating the opening area of the orifice as an opening area of the throttle valve to arithmetically operate an acceleration increase correction value of injection time based on the estimated opening area; and means for correcting an injection amount in acceleration of the engine using the arithmetically operated acceleration increase correction value.

13 Claims, 5 Drawing Sheets

ENGINE THROTTLE OPENING DEGREE AREA ESTIMATION METHOD, AS WELL AS ENGINE ACCELERATION DETECTION METHOD AND DEVICE AND ENGINE FUEL INJECTION CONTROL METHOD AND DEVICE USING THE ESTIMATION METHOD

TECHNICAL FIELD OF THE INVENTION

The present invention relates to a throttle opening area estimation method for estimating an opening area of a throttle valve from intake pipe pressure of an engine, as well as an engine acceleration detection method and device and an engine fuel injection control method and device using the estimation method.

BACKGROUND OF THE INVENTION

In four-cycle gasoline engines (internal combustion engines) included in automobiles or the like, electronically controlled fuel injection devices have been used in order to deal with emission control, improve fuel economy, or improve driving performance.

For an engine in which fuel injection is electronically controlled, an amount of air flowing into a cylinder needs to be estimated in order to determine an amount of fuel injected from an injector so as to obtain air-fuel mixture with a predetermined air-fuel ratio. As a method for estimating an inflow air amount into a cylinder of an engine, a method (a speed density method) is known for estimating an inflow air amount from intake pipe pressure (pressure within an intake pipe) and a rotational speed of an engine.

For an engine in which a fuel injection amount is arithmetically operated with respect to an intake air amount estimated from intake pipe pressure and a rotational speed, an air-fuel ratio goes lean by detection delay of intake pressure when a driver abruptly opens a throttle in an attempt to accelerate a vehicle, thereby causing deterioration of exhaust gas components or degradation of driving performance of the engine. In order to avoid such problems, acceleration increase correction for increasing a fuel injection amount according to an amount of change in throttle opening degree needs to be performed when the throttle is abruptly operated to accelerate the engine, thereby preventing the air-fuel ratio from going lean.

Generally, a throttle position sensor that detects a position of a throttle valve is used as a method for detecting an operation amount of a throttle. Using the throttle position sensor, however, inevitably increases costs of an engine. In order to reduce costs, it is required that an acceleration operation of the engine is detected without using the throttle position sensor to perform acceleration increase correction.

As a method for detecting an acceleration operation of an engine without using a throttle position sensor, Japanese Patent Application Laid-Open Publication No. 2002-242749 proposes a method for monitoring intake pipe pressure of an engine and detecting an acceleration state of the engine when the intake pipe pressure represents a predetermined change.

In a method described in Japanese Patent Application Laid-Open Publication No. 2002-242749, a plurality of preset crank angle positions are determined as sample positions, intake pipe pressure is sampled at each sample position, and intake pipe pressure newly sampled at each sample position is compared with intake pipe pressure sampled at the corresponding sample position one combustion cycle before. Then, when the intake pipe pressure newly sampled is a predetermined value or more higher than the intake pipe pressure sampled one combustion cycle before, an acceleration state of the engine is determined.

In the acceleration of the engine, the intake pipe pressure is increased by opening a throttle valve. Thus, the intake pipe pressure sampled at each sample position is compared with the intake pipe pressure sampled at the corresponding sample position one combustion cycle before to detect that the intake pipe pressure newly sampled is a predetermined level or more higher than the intake pipe pressure sampled one combustion cycle before, thereby allowing the acceleration state of the engine to be detected. The degree of acceleration can be determined by, for example, checking a rate of change with time in a difference between the intake pipe pressure newly sampled and the intake pipe pressure sampled at the corresponding sample position one combustion cycle before.

With the acceleration detection method described in Japanese Patent Application Laid-Open Publication No. 2002-242749, the acceleration state of the engine can be detected without using a throttle position sensor. However, determining the plurality of crank angle positions of the engine as the sample positions and detecting the acceleration based on the intake pipe pressure sampled at each sample position causes the following problems.

The intake pipe pressure quickly decreases in an intake stroke, and represents a minimum value at an end of the intake stroke or a start of a compression stroke. The intake pipe pressure represents the minimum value, and then gradually increases until immediately before the next intake stroke. The degree of increase in a process for the intake pipe pressure to increase is controlled by a time constant determined by an opening area of a throttle valve (a throttle opening area) and a capacity of an intake pipe between the throttle valve and an intake valve (a capacity of the intake pipe downstream of the throttle valve). The intake valve is closed in the process for the intake pipe pressure to increase, and thus the intake pipe pressure is independent of movement of a piston (a crank angle).

When a throttle opening degree is small in the process for the intake pipe pressure to increase, a low flow rate of air passes through an opening of the throttle valve and the intake pipe pressure thus increases slowly, while when the throttle opening degree is large, a high flow rate of air passes through the opening of the throttle valve and the intake pipe pressure thus increases quickly. Thus, in a period when the intake pipe pressure increases after the intake stroke is finished, the intake valve is closed and thus independent of the crank angle. Also, the capacity of the intake pipe is fixed, and thus the intake pipe pressure is determined by the opening area of the throttle valve and elapsed time.

In the proposed acceleration and deceleration detection method, the preset crank angle positions are determined as the sample positions to sample the intake pipe pressure even in the period when the intake pipe pressure increases after the intake stroke is finished. Thus, in a state where a rotational speed of the engine changes (a transient state), the intake pipe pressure sampled at each sample position and the intake pipe pressure sampled at the corresponding sample position one combustion cycle before do not have correspondence as a subject of comparison, and the state of acceleration of the engine cannot be accurately detected.

The change in the intake pipe pressure after the intake valve is closed is determined by the opening area of the throttle valve and the elapsed time, and thus it is supposed that information on the opening area of the throttle valve is obtained from the change in the intake pipe pressure and used for various types of control of the engine. If the information on the opening area of the throttle valve can be obtained without using a throttle sensor, costs of control devices can be reduced when various types of control amounts are controlled with respect to the opening area of the throttle valve in addition to fuel injection control.

As described above, the acceleration of the engine has been detected from the change in the intake pipe pressure, but the information on the opening area of the throttle valve has not been obtained from the intake pipe pressure.

SUMMARY OF THE INVENTION

An object of the invention is to provide an engine throttle opening area estimation method capable of accurately obtaining information on an opening area of a throttle valve from intake pipe pressure of an engine.

Another object of the invention is to provide an engine acceleration detection method and device capable of accurately detecting an acceleration state of an engine without using a throttle position sensor.

A further object of the invention is to provide an engine fuel injection control method and device capable of accurately correcting a fuel injection amount when an engine is in an acceleration state and controlling the fuel injection amount to prevent deterioration of exhaust gas components or degradation of drivability.

With the throttle opening area estimation method according to the invention, an amount of change per minimal time in intake pipe pressure of an engine is detected as an intake pipe pressure change amount, an arithmetical operation of calculating an opening area of an orifice from a relationship between a mass flow rate of gas and the intake pipe pressure change amount is performed in a process for the intake pipe pressure to increase after an intake valve of the engine is closed, the gas flowing through the orifice by a difference in pressure on both sides of the orifice when a throttle valve of the engine is regarded as the orifice, and the arithmetically operated opening area of the orifice is estimated as an opening area of the throttle valve.

When the throttle valve is regarded as the orifice, a mass flow rate of air flowing through the orifice can be calculated by the opening area of the orifice, a difference in pressure between the front and back of the orifice, a specific volume of air, a flow coefficient, and acceleration of gravity. When the intake valve is closed, a change in pressure per minimal time within the intake pipe is determined by the mass flow rate of the air passing through the orifice, and with a temperature being fixed, the change in pressure per minimal time within the intake pipe is determined by the mass flow rate of the air passing through the orifice, and a predetermined constant. Thus, the opening area of the orifice can be arithmetically operated from the change in the intake pipe pressure per minimal time when the intake valve is closed, a difference in pressure between the front and back of the throttle valve, and a predetermined constant.

The inventor has compared the opening area of the orifice thus calculated with an opening area of the throttle valve arithmetically operated from a throttle opening degree detected by a throttle position sensor, and confirmed that in the process for the intake pipe pressure to increase, the opening area of the orifice and the opening area of the throttle valve arithmetically operated from the throttle opening degree detected by the throttle position sensor change substantially in the same manner with respect to a change in the throttle opening degree, and are correlated with each other.

Thus, as described above, the throttle valve is regarded as the orifice, and the opening area of the orifice calculated in the process for the intake pipe pressure to increase is estimated as the opening area of the throttle valve, thereby allowing information on the opening area of the throttle valve to be obtained without using the throttle position sensor.

The opening area of the orifice Ao can be arithmetically operated based on an arithmetical operation expression $Ao=K\cdot\{\Delta Pb/(Po-Pb)^{1/2}\}$ that expresses a relationship between the opening area of the orifice Ao, and inlet side pressure of the throttle valve of the engine Po, the intake pipe pressure (negative pressure) Pb, the intake pipe pressure change amount $\Delta Pb$, and a constant K. The opening area Ao is herein arithmetically operated based on the arithmetical operation expression, which means that the opening area Ao may be arithmetically operated using the arithmetical operation expression itself or an opening area arithmetical operation map prepared based on the arithmetical operation expression. A map arithmetical operation is preferable for a quick arithmetical operation.

The arithmetical operation of the opening area of the orifice that can be estimated as the opening area of the throttle valve needs to be performed in the process for the intake pipe pressure to increase with the intake valve being closed. When a difference between the inlet side pressure Po of the throttle valve and the intake pipe pressure Pb becomes close to zero, measurement errors of the intake pipe pressure significantly impact arithmetical operation results of the opening area of the orifice to increase a difference between the opening area of the orifice and the actual opening area of the throttle valve and make it difficult to estimate the opening area of the orifice as the opening area of the throttle valve. Thus, even in a period when the intake pipe pressure increases, it is preferable that the estimation is not performed in a region where the intake pipe pressure becomes close to atmospheric pressure. The difference between the opening area of the orifice and the actual opening area of the throttle valve is also increased in a region with a small intake pipe pressure change amount, and thus it is preferable that the estimation of the opening area of the orifice as the opening area of the throttle valve is permitted only in a period after timing when the intake pipe pressure change amount exceeds a set value.

Thus, in a preferable aspect of the invention, an intake pipe pressure increasing period between timing when the intake pipe pressure change amount exceeds a set value and timing when the intake pipe pressure reaches a preset estimation permission pressure upper limit value after the intake valve of the engine is closed is determined as an estimation permission period, and the opening area of the orifice calculated during the estimation permission period is estimated as the opening area of the throttle valve.

According to the invention, there is also provided an engine acceleration detection method for detecting an acceleration state of an engine.

With the acceleration detection method according to the invention, intake pipe pressure of the engine is sampled at minimal time intervals, and a difference between intake pipe pressure newly sampled and intake pipe pressure sampled last time is detected as an intake pipe pressure change amount. Then, a throttle opening area estimation process is performed, during an estimation permission period, where an intake pipe pressure increasing period between timing when the intake pipe pressure change amount exceeds a set value and timing when the intake pipe pressure newly sampled reaches a preset estimation permission pressure upper limit value after an intake valve of the engine is closed is determined as the estimation permission period, and an opening area of an orifice is arithmetically operated from a relationship between a mass flow rate of gas and the intake pipe pressure change amount to determine the opening area of the orifice as an estimated opening area of a throttle valve of the engine, the gas flowing through the orifice by a difference in pressure on both sides of the orifice when the throttle valve of the engine is regarded as the orifice. When an increase in the estimated opening area of the throttle valve calculated during the estimation permission period is detected, an acceleration state of the engine is detected.

When the acceleration of the engine is detected using the estimated opening area of the throttle valve, it is preferable that the acceleration is not detected when the estimated opening area arithmetically operated from the intake pipe pressure newly sampled is larger than the estimated opening area arithmetically operated from the intake pipe pressure sampled last time, but the acceleration state of the engine is detected when a difference between the estimated opening area newly calculated during the estimation permission period and a minimum value of the estimated opening area calculated during the same estimation permission period is equal to or larger than a set determination value.

According to the acceleration detection method, the acceleration state of the engine may be accurately detected from the intake pipe pressure without using a throttle position sensor.

According to the invention, there is also provided an acceleration detection device for detecting an acceleration state of an engine.

The acceleration detection device according to the invention includes: intake pipe pressure sampling means for sampling intake pipe pressure of the engine at minimal time intervals; intake pipe pressure change amount detection means for detecting a difference between intake pipe pressure newly sampled by the intake pipe pressure sampling means and intake pipe pressure sampled last time as an intake pipe pressure change amount; throttle opening area estimation means for performing, during an estimation permission period, a throttle opening area estimation process where an opening area of an orifice is arithmetically operated from a relationship between a mass flow rate of gas and the intake pipe pressure change amount to determine the opening area of the orifice as an estimated opening area of a throttle valve of the engine, the gas flowing through the orifice by a difference in pressure on both sides of the orifice when the throttle valve of the engine is regarded as the orifice, wherein an intake pipe pressure increasing period between timing when the intake pipe pressure change amount exceeds a set value and timing when the intake pipe pressure reaches a preset estimation permission pressure upper limit value after an intake valve of the engine is closed is determined as the estimation permission period; and acceleration determination means for determining an acceleration state of the engine when a difference between the estimated opening area newly calculated during each estimation permission period and a minimum value of the estimated opening area calculated during the same estimation permission period is equal to or larger than a set determination value.

According to the invention, there is also provided an engine fuel injection control method for performing a process of estimating an intake air amount from intake pipe pressure and a rotational speed of an engine, and an injection time arithmetical operation process of arithmetically operating an actual injection time based on a basic injection time of fuel determined with respect to the estimated intake air amount, and controlling an injector so as to inject fuel during the actual injection time arithmetically operated in the injection time arithmetical operation process.

With the fuel injection control method according to the invention, the intake pipe pressure of the engine is sampled at minimal time intervals, and a difference between intake pipe pressure newly sampled and intake pipe pressure sampled last time is detected as an intake pipe pressure change amount. Then, a throttle opening area estimation process is performed, during an estimation permission period where an intake pipe pressure increasing period between timing when the intake pipe pressure change amount exceeds a set value and timing when the intake pipe pressure newly sampled reaches a preset estimation permission pressure upper limit value after an intake valve of the engine is closed is determined as the estimation permission period, and an opening area of an orifice is arithmetically operated from a relationship between a mass flow rate of gas and the intake pipe pressure change amount to determine the opening area of the orifice as an estimated opening area of a throttle valve of the engine, the gas flowing through the orifice by a difference in pressure on both sides of the orifice when the throttle valve of the engine is regarded as the orifice. In the injection time arithmetical operation process, the estimated opening area calculated in the throttle opening area estimation process is used to arithmetically operate an acceleration increase correction value, and the acceleration increase correction value is added to injection time calculated by correcting the basic injection time under various control conditions to arithmetically operate the actual injection time.

In the injection time arithmetical operation process, it is preferable that an estimated opening area change amount is calculated by subtracting, from the estimated opening area newly calculated, a minimum value of the estimated opening area calculated during the same estimation permission period, and the estimated opening area change amount is used to arithmetically operate the acceleration increase correction value when the estimated opening area change amount is positive, every time the estimated opening area is newly calculated during the estimation permission period.

The estimated opening area Ao can be arithmetically operated based on an arithmetical operation expression $Ao=K\cdot\{(Pb'-Pb)/(Po-Pb)^{1/2}\}$ that expresses a relationship between inlet side pressure of the throttle valve of the engine Po, the intake pipe pressure newly sampled Pb', intake pipe pressure sampled last time Pb and a constant K, and the opening area Ao.

According to the invention, there is also provided an engine fuel injection control device including: intake air amount estimation means for estimating an intake air amount from intake pipe pressure and a rotational speed of an engine; injection time arithmetical operation means for arithmetically operating an actual injection time based on a basic injection time of fuel determined with respect to the intake air amount estimated by the intake air amount estimation means; and injector control means for controlling an injector so as to inject fuel during the actual injection time arithmetically operated by the injection time arithmetical operation means.

The fuel injection control device includes: intake pipe pressure sampling means for sampling the intake pipe pressure of the engine at minimal time intervals; intake pipe pressure change amount detection means for detecting a difference between intake pipe pressure newly sampled and intake pipe pressure sampled last time as an intake pipe pressure change amount; throttle opening area estimation means for performing, during an estimation permission period, a throttle opening area estimation process where an opening area of an orifice is arithmetically operated from a relationship between a mass flow rate of gas and the intake pipe pressure change amount to determine the opening area of the orifice as an estimated opening area of a throttle valve of the engine, the gas flowing through the orifice by a difference in pressure on both sides of the orifice when the throttle valve of the engine is regarded as the orifice, wherein an intake pipe pressure increasing period between timing when the intake pipe pressure change amount exceeds a set value and timing when the intake pipe pressure reaches a preset estimation permission pressure upper limit value after an intake valve of the engine is closed is determined as the estimation permission period; and intake pipe pressure minimum value detection means for detecting a minimum value of the intake pipe pressure sampled in each combustion cycle.

In this case, the injection time arithmetical operation means is comprised so as to arithmetically operate an acceleration increase correction value from the estimated opening area calculated in the throttle opening area estimation process and the latest data of the minimum value of the intake pipe pressure already detected by the intake pipe pressure minimum value detection means, and add the acceleration increase correction value to injection time calculated by correcting the basic injection time under various control conditions to arithmetically operate the actual injection time.

In a preferable aspect of the invention, the injection time arithmetical operation means is comprised so as to calculate an estimated opening area change amount by subtracting, from the estimated opening area newly calculated, the minimum value of the estimated opening area calculated during the same estimation permission period, arithmetically operate the acceleration increase correction value from the estimated opening area change amount and the latest data of the minimum value of the intake pipe pressure already detected by the intake pipe pressure minimum value detection means when the estimated opening area change amount is positive, and add the acceleration increase correction value to the injection time calculated by correcting the basic injection time under various control conditions to arithmetically operate the actual injection time, every time the estimated opening area is newly calculated during the estimation permission period.

BRIEF DESCRIPTION OF THE DRAWINGS

The above and other objects and features of the present invention will be apparent from the detailed description of the preferred embodiment of the invention, which is described and illustrated with reference to the accompanying drawings, in which.

DETAILED DESCRIPTION OF THE PREFERRED EMBODIMENT

Now, a preferred embodiment of the invention will be described with reference to the drawings.

Figure 1:
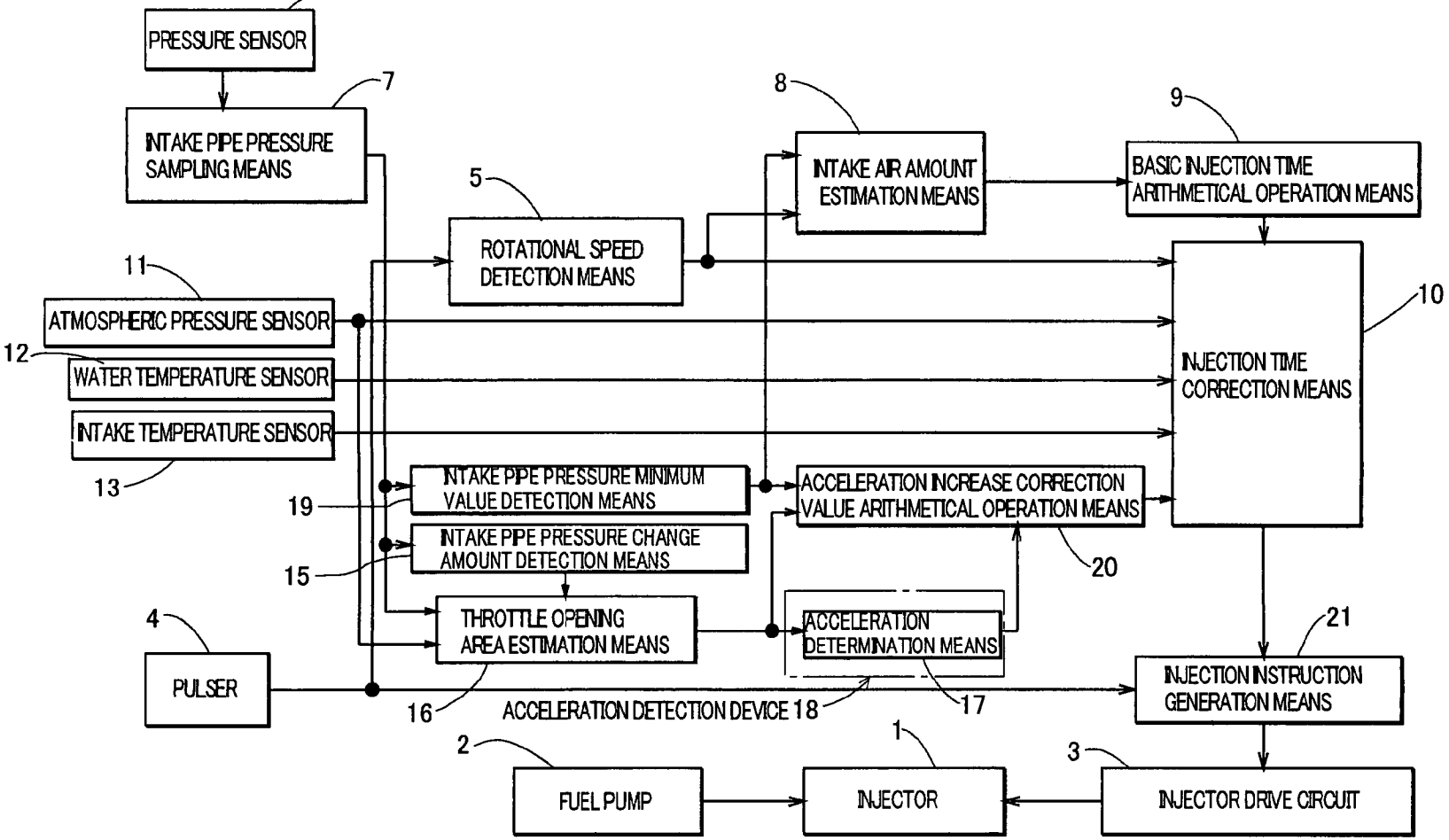
FIG. 1 is a block diagram of a construction of an engine fuel injection control device according to an embodiment of the invention.

FIG. 1 shows an embodiment of a fuel injection control device according to the invention. In FIG. 1, a reference numeral 1 denotes an injector that is mounted to an intake pipe of an engine and injects fuel into the intake pipe, 2 denotes a fuel pump that provides fuel to the injector 1 from a fuel tank, and 3 denotes an injector drive circuit that provides a drive current to the injector 1 while an injection instruction is provided. The injector injects the fuel into the intake pipe of the engine while the drive current is provided from the drive circuit 3. Pressure of the fuel provided from the fuel pump 2 to the injector 1 is kept constant by a pressure adjustor, and thus an amount of fuel injected from the injector 1 (an injection amount) is controlled by time for injecting the fuel from the injector (injection time).

A reference numeral 4 denotes a pulser (a pulse signal generator) that generates pulse signals at a predetermined rotational angle position of a crankshaft of the engine, and the pulse signals generated by the pulser are provided through a waveform shaping circuit to a microcomputer (not shown). The microcomputer interrupts a main routine every time the pulser 4 generates a pulse signal at a predetermined crank angle position and read time measured by a timer. Then, time Tn required for one rotation of the crankshaft of the engine from the read time and time read last time at the same crank angle position is arithmetically operated, and rotational speed of the engine is arithmetically operated from the time Tn. Thus, rotational speed detection means 5 is comprised by a process of measuring the time required for one rotation of the engine from an output of the pulser 4, and a process of arithmetically operating the rotational speed from the time.

A reference numeral 6 denotes a pressure sensor mounted to the intake pipe of the engine, and the pressure sensor detects pressure within the intake pipe downstream of a throttle valve of the engine as intake pipe pressure. A reference numeral 7 denotes intake pipe pressure sampling means for sampling an output of the pressure sensor 6 at sample timing that comes at minimal time intervals, and 8 denotes intake air amount estimation means for estimating an intake air amount of the engine from the intake pipe pressure sampled by the intake pipe pressure sampling means 7 and the rotational speed detected by the rotational speed detection means 5.

The intake air amount estimation means 8 is means for estimating the intake air amount of the engine, and in the embodiment, an intake air amount arithmetical operation map is searched with respect to the rotational speed of the engine and a minimum value of intake pipe pressure detected by below described intake pipe pressure minimum value detection means, and a searched value is interpolated to calculate an estimated value of the intake air amount of the engine. The estimated value of the intake air amount calculated by the intake air amount estimation means 8 is provided to basic injection time arithmetical operation means 9.

The basic injection time arithmetical operation means 9 arithmetically operates an injection amount of fuel required for obtaining air-fuel mixture with a predetermined air-fuel ratio with respect to the intake air amount estimated by the intake air amount estimation means 8, and arithmetically operates injection time required for injecting fuel of the arithmetically operated injection amount from the injector 1 as basic injection time.

A reference numeral 10 denotes injection time correction means for correcting the basic injection time arithmetically operated by the basic injection time arithmetical operation means 9 under various types of conditions to arithmetically operate actual injection time, and to the injection time correction means 10, the rotational speed detected by the rotational speed detection means 5, atmospheric pressure detected by an atmospheric pressure sensor 11, a temperature of cooling water of the engine detected by a water temperature sensor 12, and an intake temperature detected by an intake temperature sensor 13 are provided as control conditions.

The injection time correction means 10 multiplies the basic injection time by a rotational speed correction coefficient, an atmospheric pressure correction coefficient, a cooling water temperature correction coefficient, and an intake temperature correction coefficient determined with respect to the rotational speed, the atmospheric pressure, the cooling water temperature, and the intake temperature, respectively, to arithmetically operate injection time corrected with respect to the rotational speed, the atmospheric pressure, the cooling water temperature, and the intake temperature.

In the embodiment, there are also provided an intake pipe pressure change amount detection means 15, a throttle opening area estimation means 16, an acceleration detection device 18 constituted by an acceleration determination means 17, an intake pipe pressure minimum value detection means 19, and an acceleration increase correction value arithmetical operation means 20 in order to estimate an opening area of the throttle valve, detect an acceleration state of the engine, and further correct the injection time calculated by correcting the basic injection time under the various control conditions (in this embodiment, the rotational speed, the atmospheric pressure, the cooling water temperature, and the intake temperature) when the acceleration state of the engine is detected.

The intake pipe pressure change amount detection means 15 is means for detecting an amount of change per minimal time in the intake pipe pressure, and detects a difference between intake pipe pressure newly sampled by the intake pipe pressure sampling means 7 and intake pipe pressure sampled last time as an intake pipe pressure change amount.

The throttle opening area estimation means 16 is means for performing a series of processes of estimating the opening area of the throttle valve by a throttle opening area estimation method according to the invention. With this estimation method, an intake pipe pressure increasing period between timing when the intake pipe pressure change amount exceeds a set value and timing when the intake pipe pressure reaches a preset estimation permission pressure upper limit value after an intake valve of the engine is closed is determined as an estimation permission period, and an opening area of an orifice is arithmetically operated from a relationship between a mass flow rate of gas and the intake pipe pressure change amount to determine the opening area of the orifice as an estimated opening area of the throttle valve of the engine, the gas flowing through the orifice by a difference in pressure on both sides of the orifice when the throttle valve of the engine is regarded as the orifice.

The acceleration determination means 17 is means for determining whether the engine is in the acceleration state, and determines that the engine is in the acceleration state when an increase in the estimated opening area of the throttle valve calculated by the throttle opening area estimation means 16 during the estimation permission period is detected.

In the determination of the increase in the estimated opening area, an estimated opening area newly calculated may be compared with an estimated opening area calculated at the last sample timing. Such a comparison, however, is not preferable because measurement errors or the like of the intake pipe pressure significantly impact the estimated opening area to increase a difference between the estimated opening area and the actual opening area of the throttle valve as the intake pipe pressure becomes close to the estimation permission pressure upper limit value PbAocal.

Thus, in a preferable aspect of the invention, it is determined that the engine is in the acceleration state when the estimated opening area newly calculated during each estimation permission period is a set determination value or more larger than a minimum value of the estimated opening area already calculated during the same estimation permission period (when a difference between the estimated opening area newly calculated during each estimation permission period and the minimum value of the estimated opening area calculated during the same estimation permission period is equal to or larger than the set determination value). This allows the acceleration state to be accurately detected even if the estimated opening area changes to some extent by arithmetical operation errors.

The intake pipe pressure minimum value detection means 19 is means for detecting the minimum value of the intake pipe pressure during the estimation permission period, and compares the intake pipe pressure newly sampled with the minimum value of the intake pipe pressure already sampled during the estimation permission period to calculate the minimum value of the intake pipe pressure, every time the intake pipe pressure is newly sampled at each sample timing.

The acceleration increase correction value arithmetical operation means 20 is means for arithmetically operating correction time to be added to the injection time calculated by correcting the basic injection time with respect to the rotational speed, the atmospheric pressure, the cooling water temperature, and the intake temperature as an acceleration increase correction value in order to increase an injection amount when the acceleration state of the engine is determined. This arithmetical operation means arithmetically operates the acceleration increase correction value from the estimated opening area of the throttle valve calculated by the throttle opening area estimation means 16 and the latest data of the minimum value of the intake pipe pressure detected by the intake pipe pressure minimum value detection means 19.

In the embodiment, the acceleration increase correction value arithmetical operation means 20 is comprised so as to calculate a difference between the estimated opening area newly calculated during each estimation permission period and the minimum value of the estimated opening area already calculated as an opening area change amount, and search an acceleration increase correction value arithmetical operation map with respect to the opening area change amount and the latest data of the minimum value of the intake pipe pressure already detected by the intake pipe pressure minimum value detection means 19 to arithmetically operate the acceleration increase correction value.

The acceleration increase correction value arithmetically operated by the acceleration increase correction value arithmetical operation means 20 is provided to the injection time correction means 10. The injection time correction means 10 adds the acceleration increase correction value arithmetically operated by the acceleration increase correction value arithmetical operation means 20 to the injection time calculated by correcting the basic injection time with respect to the rotational speed, the atmospheric pressure, the cooling water temperature, and the intake temperature to arithmetically operate the actual injection time, and provides the arithmetically operated actual injection time to injection instruction generation means 21. The injection instruction generation means 21 provides an injection instruction signal having a signal width equal to the actual injection time plus inoperative injection time (time between when the injector starts to be driven and when a valve of the injector is opened to start injection of the fuel) to the injector drive circuit 3 at injection start timing detected with respect to timing when the pulser 4 generates the predetermined pulse signal. The injector drive circuit 3 drives the injector 1 while the injection instruction is provided, and causes the injector to inject the fuel during the actual injection time.

As described above, in the throttle opening area estimation method according to the invention, the difference between the intake pipe pressure newly sampled and the intake pipe pressure sampled last time (the amount of change per minimal time in the intake pipe pressure) is detected as the intake pipe pressure change amount, the intake pipe pressure increasing period between the timing when the intake pipe pressure change amount exceeds the set value and the timing when the intake pipe pressure reaches the preset estimation permission pressure upper limit value after the intake valve of the engine is closed is determined as the estimation permission period, and the opening area of the orifice is arithmetically operated, during the estimation permission period, from the relationship between the mass flow rate of gas and the intake pipe pressure change amount to determine the opening area of the orifice as the estimated opening area, the gas flowing through the orifice by the difference in pressure on the both sides of the orifice when the throttle valve of the engine is regarded as the orifice, and the estimated opening area arithmetically operated is estimated as the opening area of the throttle valve of the engine. Then, the acceleration state of the engine is detected from the change in the opening area of the throttle valve, and the acceleration increase correction value is arithmetically operated from the opening area of the throttle valve estimated when the acceleration state of the engine is detected and the latest data of the minimum value of the intake pipe pressure in a combustion cycle (the minimum value of the intake pipe pressure detected immediately before the injection timing).

Figure 2:
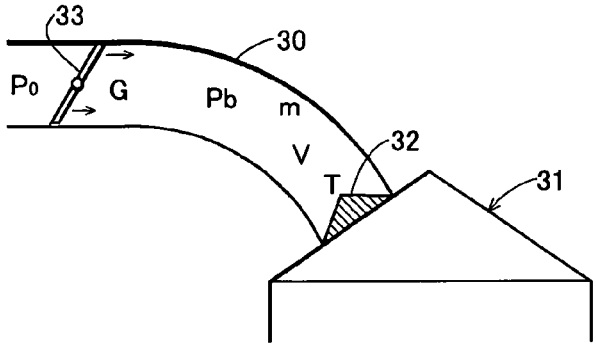
FIG. 2 is a schematic sectional view of essential portions of an engine used for describing a process of deriving an arithmetical operation expression of an opening area of an orifice used in the invention.

Now, the throttle opening area estimation method according to the invention will be further described in detail. Pressure changes within the intake pipe after an intake stroke is finished and the intake valve is closed will be considered. As shown in FIG. 2, in an engine 31 having an intake pipe 30 connected to an intake port, an intake valve 32 is closed, with pressure upstream of a throttle valve 33 (substantially atmospheric pressure) being Po, pressure Pb within the intake pipe downstream of the throttle valve (intake pipe pressure), mass of air m within the intake pipe, volume of air V, an absolute temperature T, and a mass flow rate G of air flowing through the throttle valve. In the state where the intake valve 32 is closed, an inflow amount of air passing through the throttle valve TV causes changes in the pressure Pb within the intake pipe downstream of the throttle valve.

Figure 3:
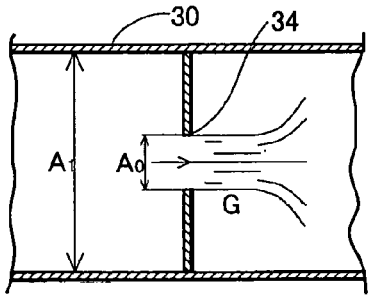
FIG. 3 is a sectional view for describing the process of deriving the arithmetical operation expression of the opening area of the orifice used in the invention.

The throttle valve is herein regarded as an orifice having a variable opening area, and as shown in FIG. 3, an orifice 34 having an opening area Ao is placed in the intake pipe 30 having a sectional area A1. At this time, a mass flow rate G of air passing through the orifice 34 is expressed by the following expression.

$$G=Cq\cdot Ao\{2g(Po-Pb)/v\}^{1/2} \quad (1)$$

where G is a mass flow rate, Ao is an opening area of the orifice, g is acceleration of gravity, v is a specific volume of air, Po is upstream pressure (substantially atmospheric pressure), Pb is downstream pressure (intake pipe pressure), and Cq is a flow coefficient.

For simplicity, when a constant and a term with small changes are expressed by $K1=Cq(2g/v)^{1/2}$, the expression (1) can be expressed by the following expression (2).

$$G=K1\cdot Ao(Po-Pb)^{1/2} \quad (2)$$

A gas equation of state at some point of time within the intake pipe 30 downstream of the throttle valve 33 is:

$$Pb\cdot V=m\cdot R\cdot T \quad (3)$$

A mass m' of the air within the intake pipe downstream of the throttle valve after minimal time has elapsed from the point of time when the expression (3) holds and the air at the mass flow rate G flows in through the throttle valve is expressed by the following expression:

$$m'=m+G \quad (4)$$

For simplicity, when the inflow of the air causes no change in temperature, the gas equation of state is:

$$Pb'\cdot V=m'\cdot R\cdot T \quad (5)$$

When the expressions (3), (4), and (5) are rearranged, the change in pressure within the intake pipe is expressed by the following expression:

$$(Pb'-Pb)=G\cdot R\cdot T/V \quad (6)$$

The opening area Ao of the orifice is calculated from the expressions (2) and (3) and expressed by the following expression:

$$Ao=(Pb'-Pb)\cdot V/K1\cdot RT(Po-Pb)^{1/2} \quad (7)$$

When a constant and a term with small changes are collectively expressed as K (=V/K1·R·T), $$Ao=K(Pb'-Pb)\cdot V/R\cdot T(Po-Pb)^{1/2} \quad (8)$$

When Pb'−Pb=ΔPb, $$Ao=K\cdot\Delta Pb\cdot V/R\cdot T(Po-Pb)^{1/2} \quad (8)'$$

In the invention, the opening area Ao of the orifice thus calculated is determined as the estimated opening area of the throttle valve.

The inventor conducted a test to check a correlation between the opening area Ao of the orifice calculated as described above and the actual opening area of the throttle valve, taking a four-cycle single cylinder engine as an example. In the test, intake pipe pressure of the engine was sampled at 2 msec intervals, and with intake pipe pressure sampled at the latest sample timing being Pb', intake pipe pressure sampled at the last sample timing Pb, pressure upstream of the orifice Po being atmospheric pressure (1013 hPa), and a constant K being an appropriate value, the opening area Ao arithmetically operated with respect to the intake pipe pressure actually sampled was arithmetically operated. Also, a throttle position sensor was mounted to the throttle valve, a throttle opening degree detected by the throttle position sensor was sampled at the same timing as the sample timing of the intake pipe pressure, and the opening area of the throttle valve was arithmetically operated with respect to each sampled throttle opening degree.

Figures 4A, 4B:
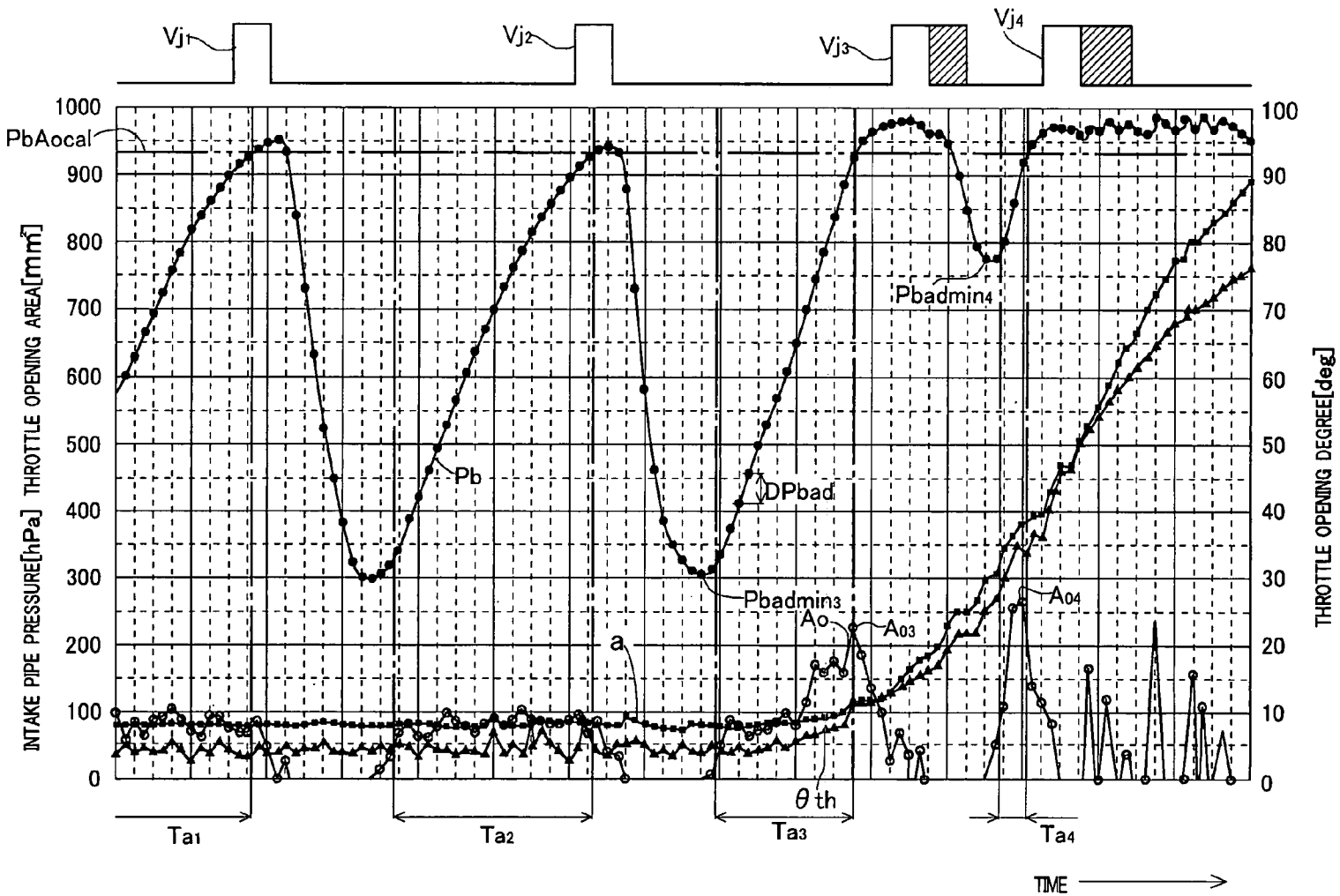
FIG. 4A is a graph showing an injection instruction provided to an injector drive circuit in a test conducted by the inventor.
FIG. 4B is a graph showing changes with time in intake pipe pressure, a throttle opening degree, and a throttle opening area measured in the test conducted by the inventor.

Arithmetical operation results of the opening area Ao of the orifice arithmetically operated from a measurement value of the intake pipe pressure Pb obtained in the above described test, a measurement value of the throttle opening degree θth, and the expression (8) are shown in FIG. 4B. The opening area of the throttle valve arithmetically operated from the throttle opening degree θth is shown by a curve a in FIG. 4B.

As is apparent from FIG. 4B, in a period when the intake valve is open and the pressure within the intake pipe decreases by the effect of pressure within the cylinder, a precondition (that the intake valve is closed, and the intake pipe pressure increases by air passing through the throttle valve) set in deriving the expression (8) is not satisfied, and thus the estimated opening area Ao arithmetically operated by the expression (8) has no correlation with the actual opening area of the throttle valve.

On the other hand, in a process for the intake pipe pressure to increase after the intake valve is closed, the estimated opening area Ao has a correlation with the actual opening area of the throttle valve (the curve a). Also in the process for the intake pipe pressure to increase, Po is assumed as constant that may actually slightly change when the denominator $(Po-Pb)^{1/2}$ of the expression (8) is small (when the intake pipe pressure is close to the atmospheric pressure), and slight measurement errors of the intake pipe pressure significantly impact the arithmetical operation results, thereby increasing the difference between the estimated opening area Ao and the actual opening area of the throttle valve and reducing estimation accuracy of the opening area of the throttle valve. In a region with an extremely small difference between the intake pipe pressure newly sampled and the intake pipe pressure sampled last time (the intake pipe pressure change amount), the estimation accuracy is also reduced.

As described above, in a period except a period of reduction in the estimation accuracy, the opening area Ao of the orifice arithmetically operated by the expression (8) and the actual opening area of the throttle valve change in a similar tendency. Thus, the period except the period of reduction in the estimation accuracy is determined as an estimation permission period, and the opening area Ao of the orifice is estimated as the opening area of the throttle valve only during the estimation permission period, thereby allowing information on the opening area of the throttle valve to be obtained.

In the invention, intake pipe pressure increasing periods between timing when a difference between intake pipe pressure newly sampled Pbad [Pb' in the expression (8)] and intake pipe pressure sampled last time Pbado [Pb in the expression (8)] (an intake pipe pressure change amount) DPbad [Pb'−Pb in the expression (8), ΔPb in the expression (8)'] exceeds a set value DPbAocal and timing when the intake pipe pressure reaches a preset value (an estimation permission pressure upper limit value) PbAocal after the intake valve is closed are determined as estimation permission periods Ta1, Ta2, . . . . The set value DPbAocal and the estimation permission pressure upper limit value PbAocal are set so that a period when the correlation between the estimated opening area Ao and the actual opening area of the throttle valve significantly breaks down is omitted from the estimation permission periods Ta1, Ta2, . . . .

In FIG. 4B, during the estimation permission periods Ta1 and Ta2 when the throttle opening degree θth represents substantially a constant value, the estimated opening area Ao arithmetically operated by the expression (8) is substantially constant, and the value of the estimated opening area Ao substantially corresponds to the actual opening area of the throttle valve (the curve a).

During an estimation permission period Ta3, the throttle opening degree is increased to accelerate the engine. Also during the period Ta3, the estimated opening area Ao arithmetically operated by the expression (8) substantially corresponds to the actual opening area of the throttle valve (the curve a) in a region with a large difference between the intake pipe pressure and the atmospheric pressure. In a region with a small difference between the intake pipe pressure and the atmospheric pressure during the period Ta3, the measurement errors of the intake pipe pressure significantly impact the arithmetical operation results of the estimated opening area to increase the difference between the estimated opening area Ao and the actual opening area of the throttle valve, but the change in the estimated opening area Ao is correlated with the change in the opening area of the throttle valve.

During an estimation permission period Ta4, the throttle opening degree is larger. During the period Ta4, the difference between the intake pipe pressure Pb and the atmospheric pressure is considerably small to increase the difference between the estimated opening area Ao arithmetically operated by the expression (8) and the actual opening area of the throttle valve, but the change in the estimated opening area Ao is correlated with the change in the opening area of the throttle valve.

As described above, during the intake pipe pressure increasing periods Ta1, Ta2, Ta3, . . . between the timing when the different between the intake pipe pressure newly sampled Pbad and the intake pipe pressure sampled last time Pbado (the intake pipe pressure change amount) DPbad exceeds the set value and the timing when the intake pipe pressure newly sampled Pbad reaches the preset value PbAocal after the intake valve is closed, the estimated opening area Ao represent changes like the actual opening area of the throttle valve in acceleration of the engine, and thus the estimated opening area Ao is estimated as the opening area of the throttle valve to allow information on the change in the actual opening area of the throttle valve to be obtained without using the throttle position sensor.

Thus, in the invention, the above described periods Ta1, Ta2, Ta3, . . . each are determined as the estimation permission periods, and the estimation of the arithmetically operated estimated opening area Ao as the opening area of the throttle valve is permitted only during the estimation permission periods Ta1, Ta2, Ta3, . . . . The periods other than the estimation permission periods Ta1, Ta2, Ta3, . . . are determined as mask periods, and the estimation of the opening area of the throttle valve is prohibited during each mask period.

The throttle opening area estimation means 16 in FIG. 1 arithmetically operates the opening area Ao of the orifice by the expression (8) from the sampled intake pipe pressure when the sampled intake pipe pressure Pbad is equal to or lower than the estimation permission pressure upper limit value PbAocal and the intake pipe pressure change amount DPbad changes by the set value DPbAocal or more in an increasing direction, and the arithmetically operated opening area Ao is determined as the estimated opening area of the throttle valve.

The expression (8) includes an arithmetical operation of square root, and an arithmetical operation using the expression as it is takes time. To quickly perform the arithmetical operation, it is preferable that with Po being, for example, standard atmospheric pressure, a three-dimensional map that provides a relationship among the intake pipe pressure change amount DPbad, the intake pressure Pbad, and the estimated opening area Ao (an estimated opening area arithmetical operation map) is prepared based on the expression (8), and this map is searched with respect to DPbad and Pbad to arithmetically operate the estimated opening area Ao.

The acceleration increase correction value arithmetical operation means 20 searches the acceleration increase correction value arithmetical operation map from a minimum value Pbadmin of the intake pipe pressure detected in one combustion cycle and the estimated opening area Ao to arithmetically operate an acceleration increase correction value ACCINJ, and the arithmetically operated correction value is provided to the injection time correction means 10. The injection time correction means 10 adds the acceleration increase correction value ACCINJ to the injection time calculated by correcting the basic injection time under the various control conditions to arithmetically operate the actual injection time.

The minimum value of the intake pipe pressure in each combustion cycle increases when the throttle valve is opened and the engine is accelerated, and decreases when the throttle valve is closed. Thus, as described above, the acceleration increase correction value ACCINJ is arithmetically operated according to the minimum value of the intake pipe pressure in each combustion cycle and the opening area of the throttle valve estimated from the intake pipe pressure, and the acceleration increase correction value ACCINJ is added to the injection time calculated by correcting the basic injection time under the various control conditions, thereby allowing the fuel injection amount in the acceleration of the engine to be accurately corrected.

FIG. 4A shows injection instruction signals Vj1, Vj2, . . . provided to the injector drive circuit 3 by the injection instruction generation means 21 when the intake pipe pressure changes as shown in FIG. 4B. The injector drive circuit 3 applies a drive voltage to the injector 1 to drive the injector while the injection instruction signals are provided. Among the injection instruction signals Vj1, Vj2, . . . shown in FIG. 4A, Vj3 and Vj4 are injection instruction signals subjected to acceleration increase correction based on the latest data of the minimum value of the estimated opening area Ao and the intake pipe pressure, and signal widths of diagonally shaded portions in these injection instruction signals match the acceleration increase correction value.

An acceleration increase correction value that defines a signal width of a diagonally shaded portion in the injection instruction signal Vj3 is arithmetically operated based on a minimum value Pbadmin3 of the intake pressure detected immediately before the signal and an opening area Ao3 of the throttle valve estimated last during the estimation permission period Ta3. An acceleration increase correction value that defines a signal width of a diagonally shaded portion in the injection instruction signal Vj4 is arithmetically operated based on a minimum value Pbadmin4 of the intake pressure detected immediately before the signal and an opening area Ao4 of the throttle valve estimated last during the estimation permission period Ta4.

As described above, in the method described in Japanese Patent Application Laid-Open Publication No. 2002-242749, newly sampled intake pipe pressure is compared with intake pipe pressure sampled at the corresponding sample position one combustion cycle before to detect acceleration of an engine. Thus, in a state where a rotational speed of the engine changes, the intake pipe pressure sampled at each sample position and the intake pipe pressure sampled at the corresponding sample position one combustion cycle before do not have correspondence as a subject of comparison, and the state of acceleration of the engine cannot be accurately detected. This problem can be solved by the method described below.

Specifically, a signal generator (for example, a pulser used in the example of FIG. 1) is provided that generates a reference crank angle signal at a reference crank angle position with a specific crank angle position of an engine being the reference crank angle position, and timing that comes at minimal time intervals from timing when the reference crank angle signal is generated is determined as sample timing to sample intake pipe pressure of the engine at each sample timing. Then, a difference between the intake pipe pressure sampled at each sample timing and the intake pipe pressure sampled at the same sample timing one combustion cycle before is detected as an intake pipe pressure difference, and an acceleration state of the engine is detected when the intake pipe pressure difference exceeds a set value.

In controlling a fuel injection amount, it is supposed that when the acceleration state of the engine is detected by the above described method, an arithmetical operation of correcting the fuel injection amount in the acceleration of the engine according to the minimum value of the intake pipe pressure in each combustion cycle and a rate of increase (a gradient of increase of the intake pipe pressure) per unit time in the intake pipe pressure during an intake pipe pressure increasing period following the minimum value As described above, each sample timing is determined by elapsed time from the timing when the reference crank angle signal is generated to sample the intake pipe pressure of the engine at each sample timing, and the intake pipe pressure sampled at each sample timing is compared with the intake pipe pressure sampled at the same sample timing one combustion cycle before to detect the acceleration state of the engine. This provides proper correspondence between a sample value of the intake pipe pressure newly sampled in a section outside an intake stroke (a section where the intake pipe pressure is determined by the opening area of the throttle valve and the elapsed time) and a sample value one combustion cycle before as a subject of comparison even in a transient state where the rotational speed of the engine changes, thereby allowing the acceleration state of the engine to be detected.

However, when the arithmetical operation of correcting the fuel injection amount in the acceleration of the engine according to the minimum value of the intake pipe pressure and the rate of increase per unit time in the intake pipe pressure during the intake pipe pressure increasing period following the minimum value as described above, no difference is sometimes caused between the rate of change per unit time in the intake pipe pressure and the minimum value of the intake pipe pressure in the acceleration depending on timing of starting to open the throttle valve, and the acceleration increase correction value sometimes cannot be accurately arithmetically operated.

Figure 5:
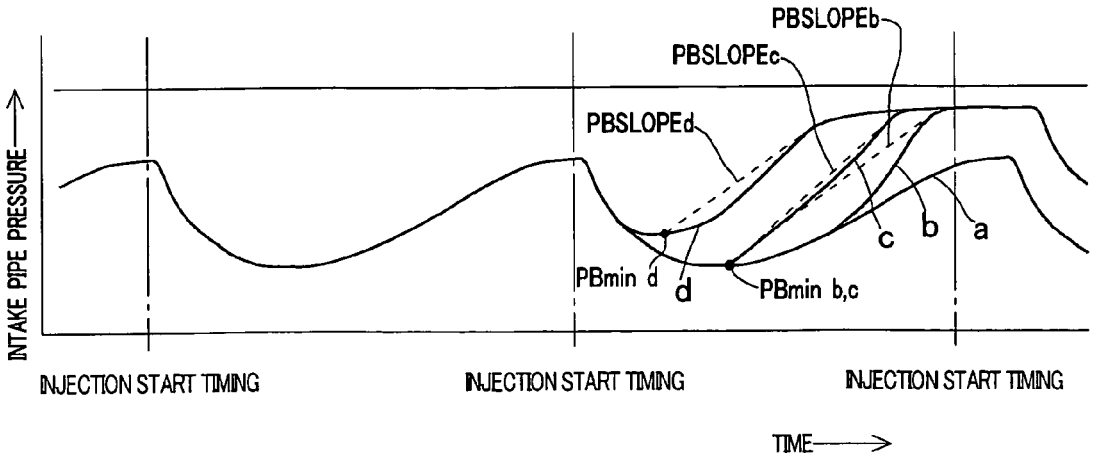
FIG. 5 is a graph for describing a method for calculating an acceleration increase correction value of a fuel injection time from the intake pipe pressure without using information on an opening area of a throttle valve.

FIG. 5 shows changes with time in the intake pipe pressure of the engine. A curve a in FIG. 5 shows a change in the intake pipe pressure when the engine is not accelerated, and a curve b shows a change in the intake pipe pressure when the throttle valve starts to be opened in an expansion stroke. A curve c shows a change in the intake pipe pressure when the throttle valve starts to be opened in a compression stroke, and a curve d shows a change in the intake pipe pressure when the throttle valve starts to be opened in an intake stroke. Further, a line PBSLOPEb shown by a broken line is a line connecting a minimum value PBminb and a value at a pressure increase stop of the curve b, and a gradient of the line shows a rate of increase per unit time in the intake pipe pressure during the intake pipe pressure increasing period when the throttle valve starts to be opened in the expansion stroke. PBSLOPEc is a line connecting a minimum value PBminc and a value at a pressure increase stop of the curve c, and a gradient of the line shows a rate of increase per unit time in the intake pipe pressure during the intake pipe pressure increasing period when the throttle valve starts to be opened in the compression stroke. Further, PBSLOPEd is a line connecting a minimum value PBmind and a value at a pressure increase stop of the curve d, and a gradient of the line shows a rate of increase per unit time in the intake pipe pressure during the intake pipe pressure increasing period when the throttle valve starts to be opened in the intake stroke.

In FIG. 5, comparing a case where the throttle valve is opened in the expansion stroke (the case of the curve b with a case where the throttle valve is opened in the compression stroke (the case of the curve c), a gradient of PBSLOPEb is smaller than a gradient of PBSLOPEc though the throttle valve is opened more abruptly (the intake pipe pressure changes more abruptly) in the case of the curve b than in the case of the curve c, and the minimum values PBminb and PBminc of the intake pipe pressure are substantially the same, thereby preventing the acceleration increase correction value from being accurately arithmetically operated.

With the method for determining each sample timing by the elapsed time from the timing when the reference crank angle signal is generated, and comparing the intake pipe pressure sampled at each sample timing with the intake pipe pressure sampled at the same sample timing one combustion cycle before, the acceleration can be detected but the information on the opening area of the throttle valve cannot be obtained.

On the other hand, in the invention, the opening area of the throttle valve is estimated from the change in the intake pipe pressure during the intake pipe pressure increasing period after the intake stroke is finished, and the acceleration is detected based on the change in the estimated value. This allows the acceleration to be accurately detected regardless of timing of starting to open the throttle valve. Also, the acceleration increase correction value can be accurately arithmetically operated based on the estimated value of the opening area of the throttle valve and the minimum value of the intake pipe pressure.

Figure 6:
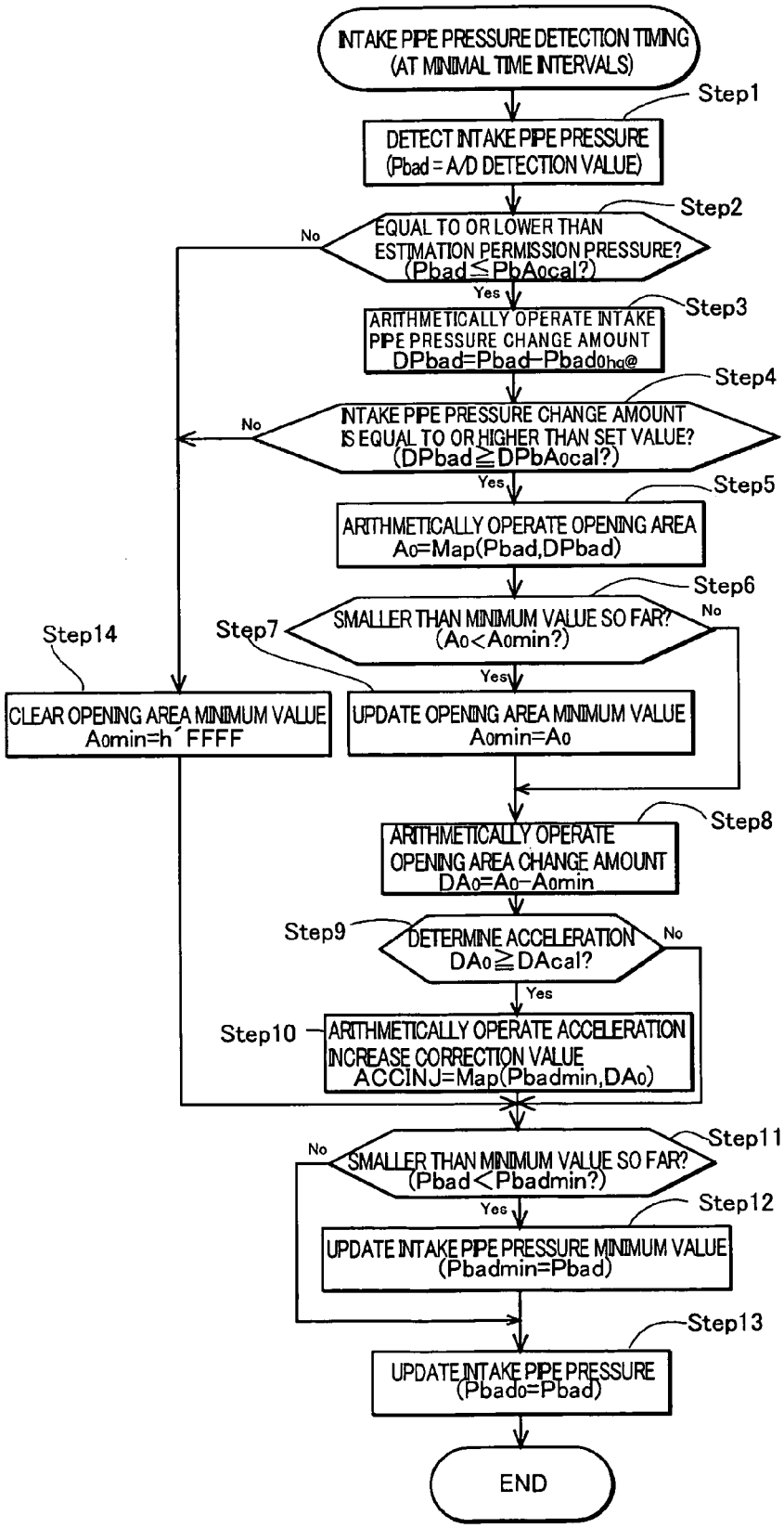
FIG. 6 is a flowchart of an example of an algorithm of a task executed by a microcomputer in the embodiment of the invention.

In the construction in FIG. 1, the rotational speed detection means 5, the intake pipe pressure sampling means 7, the intake air amount estimation means 8, the basic injection time arithmetical operation means 9, the injection time correction means 10, the intake pipe pressure change amount detection means 15, the throttle opening area estimation means 16, the acceleration determination means 17, the intake pipe pressure minimum value detection means 19, the acceleration increase correction value arithmetical operation means 20, and the injection instruction generation means 21 are configured by causing the microcomputer to execute a predetermined program. A flowchart is shown in FIG. 6 showing an algorithm of a program executed by the microcomputer in order to configure the intake pipe pressure sampling means 7, the intake pipe pressure change amount detection means 15, the throttle opening area estimation means 16, the acceleration determination means 17, the intake pipe pressure minimum value detection means 19, and the acceleration increase correction value arithmetical operation means 20 among the above described means. An algorithm for configuring the rotational speed detection means 5, the basic injection time arithmetical operation means 9, and the injection instruction generation means 21 may be the same as that used in a conventional fuel injection control device, and descriptions thereof will be omitted.

FIG. 6 shows a task executed at each sample timing (at 2 msec intervals) when intake pipe pressure is detected. According to the algorithm, first in Step 1, intake pipe pressure is detected, and a digital conversion value thereof is stored as Pbad. Then in Step 2, it is determined whether the detected intake pipe pressure is equal to or lower than an estimation permission pressure upper limit value PbAocal. When it is determined that the intake pipe pressure Pbad is equal to or lower than an estimation permission pressure upper limit value PbAocal, the process goes to Step 3, and a difference between the intake pipe pressure Pbad detected this time and intake pipe pressure Pbado detected at the last sampling (Pbad−Pbado) is arithmetically operated as an intake pipe pressure change amount DPbad. Then in Step 4, it is determined whether the intake pipe pressure change amount DPbad is equal to or higher than a set value DPAocal. When it is determined that the intake pipe pressure change amount DPbad is equal to or higher than the set value DPAocal, in Step 5, a three-dimensional map that provides a relationship among Pbad, DPbad, and the estimated opening area Ao is searched with respect to Pbad and Dpbad to arithmetically operate the estimated opening area Ao.

Then, the process goes to Step 6, and it is determined whether the estimated opening area Ao arithmetically operated in Step 5 is smaller than a minimum value Aomin of the estimated opening area arithmetically operated so far. When it is determined that the estimated opening area Ao newly arithmetically operated is smaller than the minimum value Aomin so far, the process goes to Step 7 to update the minimum value Aomin of the opening area, and in Step 8, an opening area change amount DAo (=Ao−Aomin) with respect to the minimum value of the opening area is arithmetically operated. Then, in Step 9, the opening area change amount DAo is compared with a set acceleration determination value DAcal, and when the opening area change amount DAo is equal to or higher than the determination value DAcal, acceleration is determined and the process goes to Step 10. In Step 10, an acceleration increase correction value arithmetical operation map is searched with respect to the opening area change amount DAo and an intake pipe pressure minimum value Pbadmin to arithmetically operate an acceleration increase correction value ACCINJ, and in Step 11, it is determined whether the intake pipe pressure Pbad detected this time is lower than the intake pipe pressure minimum value Pbadmin detected so far. When it is determined that the intake pipe pressure Pbad detected this time is lower than the intake pipe pressure minimum value Pbadmin detected so far, in Step 12, the intake pipe pressure minimum value Pbadmin is updated. Then in Step 13, the intake pipe pressure Pbado detected last time is replaced with the intake pipe pressure Pbad detected this time (the intake pipe pressure is updated) in preparation for the next sampling to finish the task.

In Step 10, when the opening area change amount DAo arithmetically operated in Step 8 is negative (when the estimated opening area is reduced), the acceleration increase correction value arithmetically operated last time is maintained without newly arithmetically operating the acceleration increase correction value.

When it is determined in Step 2 that the intake pipe pressure Pbad is equal to or higher than the estimated permission intake pressure PbAocal and in Step 4 that the intake pipe pressure change amount DPbad is equal to or lower than the set value DPbAocal, the process goes to Step 14 to clear the minimum value Aomin of the opening area to a maximum value h'FFFF, and then the process goes to Step 11. When it is determined in Step 6 that the estimated opening area Ao newly arithmetically operated is equal to or larger than the minimum value of the opening area arithmetically operated so far, the process moves to Step 8 without Step 7. When it is determined in Step 9 that the opening area change amount DAo is lower than the determination value DAcal (when the acceleration state is not determined), the process moves to Step 11 without Step 10. When it is determined in Step 11 that the newly detected intake pipe pressure Pbad is equal to or higher than the minimum value Pbadmin of the intake pipe pressure detected so far, the process moves to Step 13 without Step 12.

According to the algorithm in FIG. 6, the intake pipe pressure sampling means 7 is configured by Step 1, and the intake pipe pressure change amount detection means 15 is configured by Step 3. The throttle opening area estimation means 16 is configured by Steps 2, 4 and 5, and the acceleration determination means 17 is configured by Step 9. Further, the intake pipe pressure minimum value detection means 19 is configured by Steps 11 and 13, and the acceleration increase correction value arithmetical operation means 20 is configured by Step 10. Estimated opening area minimum value detection means (not shown in FIG. 1) for calculating the minimum value of the estimated opening area calculated during the estimation permission period is configured by Steps 6 and 7 in FIG. 6.

Figure 7:
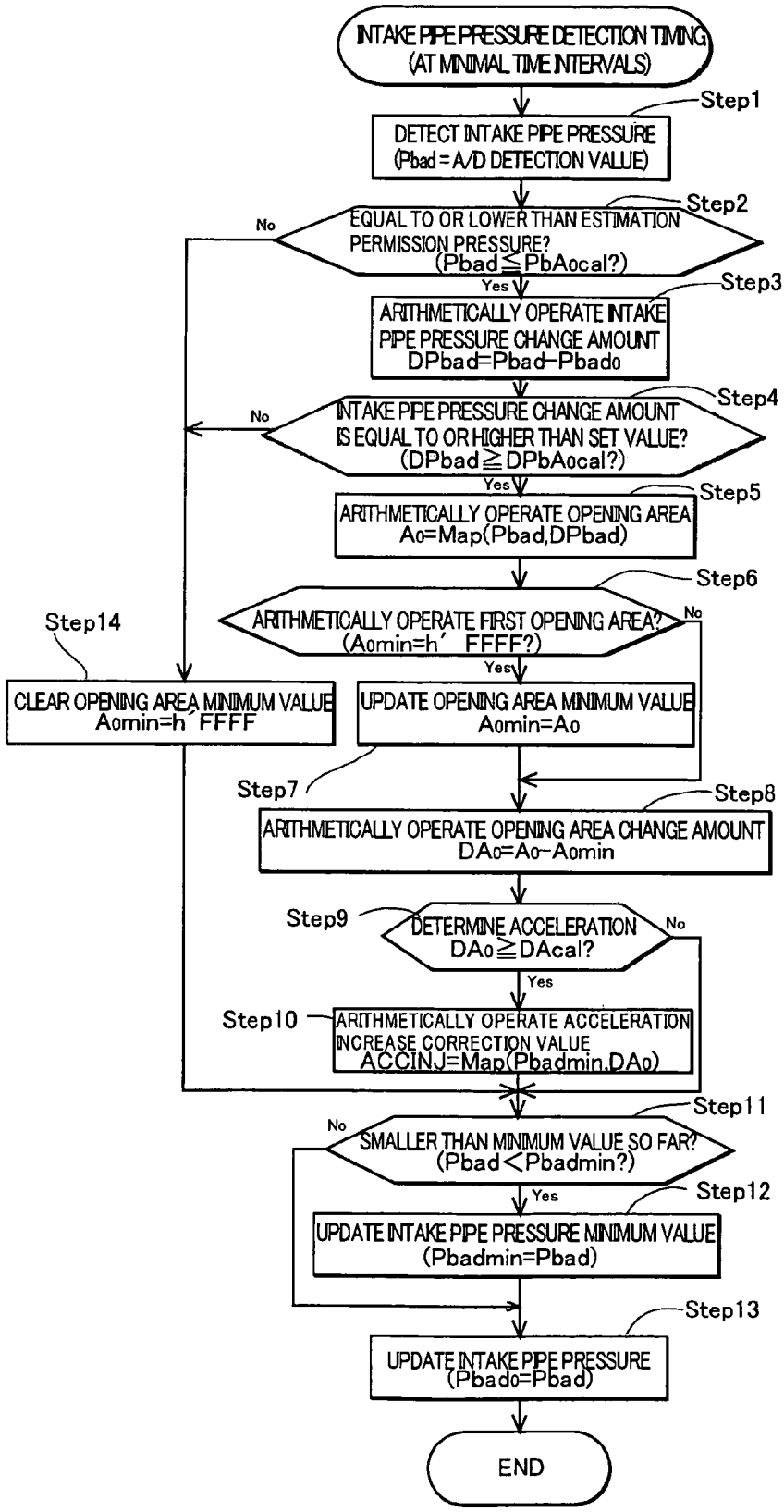
FIG. 7 is a flowchart of another example of an algorithm of a task executed by the microcomputer in the embodiment of the invention.

In the example in FIG. 6, the amount of change in the estimated opening area Ao with respect to the minimum value Aomin of the estimated opening area calculated during the estimation permission period is determined as the opening area change amount DAo, but with an opening area calculated when the estimation permission period is first detected being Aomin, the amount of change in the estimated opening area Ao with respect to Aomin may be determined as the opening area change amount DAo. An algorithm of a task executed at sampling of the intake pipe pressure in this case is shown in FIG. 7. In the task in FIG. 7, it is determined in Step 6 whether the minimum value Aomin of the opening area is cleared to the maximum value h'FFFF in order to determine whether the arithmetical operation of the opening area performed in Step 5 is the first arithmetical operation of the opening area. When the minimum value Aomin is cleared to the maximum value (when this arithmetical operation is the first arithmetical operation), the process goes to Step 7 to determine the opening area Ao arithmetically operated this time as a minimum opening area. When it is determined in Step 6 that the minimum value Aomin of the opening area is not the maximum value h'FFFF (the first arithmetical operation of the opening area has been already performed), the process moves to Step 8 without Step 7 to arithmetically operate the opening area change amount DAo. Other points are the same as in the example in FIG. 6. Also in the example in FIG. 7, the estimated opening area minimum value detection means for calculating the minimum value of the estimated opening area calculated during the estimation permission period is configured by Steps 6 and 7.

In both the examples in FIGS. 6 and 7, when the estimated opening area Ao newly calculated during the estimation permission period is a set determination value or more larger than the minimum value Aomin of the estimated opening area calculated during the same estimation permission period (when a difference between the estimated opening area newly calculated during the estimation permission period and the minimum value of the estimated opening area calculated during the same estimation permission period is equal to or larger than the set determination value), the acceleration state is determined, and with the difference between the estimated opening area newly calculated and the minimum value Aomin of the estimated opening area being the opening area change amount DAo, the acceleration increase correction value is arithmetically operated based on the opening area change amount DAo and the latest data of the minimum value of the intake pipe pressure. Thus, the acceleration state of the engine is determined to arithmetically operate the acceleration increase correction value when the estimated opening area newly calculated is the predetermined determination value or more larger than the minimum value of the estimated opening area to arithmetically operate the acceleration increase correction value, thereby allowing the acceleration state of the engine to be detected to accurately arithmetically operate the accurate acceleration increase correction value without being impacted by the arithmetical operation errors of the opening area caused by the measurement errors of the intake pipe pressure.

As described above, according to the invention, in the process for the intake pipe pressure to increase after the intake valve is closed, when the opening area of the orifice is calculated from the relationship between the mass flow rate of gas and the intake pipe pressure change amount per minimal time, the gas flowing through the orifice by the difference in pressure on the both sides of the orifice when the throttle valve is regarded as the orifice, the opening area of the orifice is correlated with the actual opening area of the throttle valve, and noting this fact, the opening area of the orifice is calculated as the estimated opening area of the throttle valve, thereby allowing the information on the opening area of the throttle valve to be obtained from the intake pipe pressure of the engine without using the throttle position sensor.

According to the invention, the acceleration state of the engine is detected from the change in the opening area of the throttle valve estimated as described above, thereby allowing the acceleration state of the engine to be accurately detected without using the throttle position sensor.

Further, according to the invention, the acceleration increase amount correction value is arithmetically operated from the information on the opening area of the throttle valve obtained by the above described throttle opening area estimation method, and the latest data of the minimum value of the intake pipe pressure already detected immediately before each injection start timing, and the acceleration increase correction value is added to the injection time calculated by correcting the basic injection time with respect to the various control conditions to arithmetically operate the actual injection time. Thus, the fuel injection amount can be accurately corrected and controlled in the acceleration without causing deterioration of exhaust gas components or degradation of drivability.

Although the preferred embodiment of the invention has been described and illustrated with reference to the accompanying drawings, it will be understood by those skilled in the art that it is by way of examples, and that various changes and modifications may be made without departing from the spirit and scope of the invention, which is defined only to the appended claims.

What is claimed is:

1. An engine throttle opening area estimation method for estimating a throttle opening area of an engine, comprising the steps of:

detecting an amount of change per minimal time in intake pipe pressure of said engine as an intake pipe pressure change amount;

performing an arithmetical operation of calculating an opening area of an orifice from a relationship between a mass flow rate of gas and said intake pipe pressure change amount in a process for the intake pipe pressure to increase after an intake valve of said engine is closed, the gas flowing through said orifice by a difference in pressure on both sides of said orifice when a throttle valve of said engine is regarded as the orifice; and estimating the opening area of said orifice as an opening area of said throttle valve.

2. The throttle opening area estimation method according to claim 1, wherein the opening area Ao of said orifice is arithmetically operated based on an arithmetical operation expression $Ao=K\cdot\{\Delta Pb/(Po-Pb)^{1/2}\}$ that expresses a relationship between inlet side pressure of the throttle valve of said engine Po, the intake pipe pressure Pb, said intake pipe pressure change amount ΔPb and a constant K, and said opening area Ao.

3. The throttle opening area estimation method according to claim 1 or 2, wherein an intake pipe pressure increasing period between timing when said intake pipe pressure change amount exceeds a set value and timing when the intake pipe pressure reaches a preset estimation permission pressure upper limit value after the intake valve of said engine is closed is determined as an estimation permission period, and the opening area of said orifice calculated during said estimation permission period is estimated as the opening area of the throttle valve.

4. An engine acceleration detection method for detecting an acceleration state of an engine, comprising the steps of:

sampling intake pipe pressure of said engine at minimal time intervals;

detecting a difference between intake pipe pressure newly sampled and intake pipe pressure sampled last time as an intake pipe pressure change amount;

performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of the engine is regarded as the orifice, wherein an intake pipe pressure increasing period between timing when said intake pipe pressure change amount exceeds a set value and timing when the intake pipe pressure newly sampled reaches a preset estimation permission pressure upper limit value after an intake valve of said engine is closed is determined as said estimation permission period; and detecting the acceleration state of said engine when an increase in the estimated opening area of the throttle valve calculated during said estimation permission period is detected.

5. An engine acceleration detection method for detecting an acceleration state of an engine, comprising the steps of:

sampling intake pipe pressure of said engine at minimal time intervals;

detecting a difference between intake pipe pressure newly sampled and intake pipe pressure sampled last time as an intake pipe pressure change amount;

performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of said engine is regarded as the orifice, wherein an intake pipe pressure increasing period between timing when said intake pipe pressure change amount exceeds a set value and timing when the intake pipe pressure newly sampled reaches a preset estimation permission pressure upper limit value after an intake valve of said engine is closed is determined as said estimation permission period; and detecting the acceleration state of said engine when the estimated opening area newly calculated during each estimation permission period is larger than a minimum value of the estimated opening area calculated during the same estimation permission period.

6. The engine acceleration detection method according to claim 4 or 5, wherein said estimated opening area Ao is arithmetically operated based on an arithmetical operation expression $Ao=K\cdot\{\Delta Pb/(Po-Pb)^{1/2}\}$ that expresses a relationship between inlet side pressure of the throttle valve of said engine Po, the intake pipe pressure Pb, said intake pipe pressure change amount ΔPb and a constant K, and said estimated opening area Ao.

7. An engine acceleration detection device for detecting an acceleration state of an engine, comprising:

intake pipe pressure sampling means for sampling intake pipe pressure of said engine at minimal time intervals;

intake pipe pressure change amount detection means for detecting a difference between intake pipe pressure newly sampled by said intake pipe pressure sampling means and intake pipe pressure sampled last time as an intake pipe pressure change amount;

throttle opening area estimation means for performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of said engine is regarded as the orifice, wherein an intake pipe pressure increasing period between timing when said intake pipe pressure change amount exceeds a set value and timing when the intake pipe pressure reaches a preset estimation permission pressure upper limit value after an intake valve of said engine is closed is determined as said estimation permission period; and acceleration determination means for determining the acceleration state of said engine when the estimated opening area newly calculated during each estimation permission period is larger than a minimum value of the estimated opening area calculated during the same estimation permission period.

8. An engine fuel injection control method for performing a process of estimating an intake air amount from intake pipe pressure and a rotational speed of an engine, and an injection time arithmetical operation process of arithmetically operating an actual injection time based on a basic injection time of fuel determined with respect to the estimated intake air amount, and controlling an injector so as to inject fuel during the actual injection time arithmetically operated in said injection time arithmetical operation process, comprising the steps of:

sampling the intake pipe pressure of said engine at minimal time intervals:

detecting a difference between intake pipe pressure newly sampled and intake pipe pressure sampled last time as an intake pipe pressure change amount;

performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of said engine is regarded as the orifice, wherein an intake pipe pressure increasing period between timing when said intake pipe pressure change amount exceeds a set value and timing when the intake pipe pressure newly sampled reaches a preset estimation permission pressure upper limit value after an intake valve of said engine is closed is determined as said estimation permission period; and detecting a minimum value of the intake pipe pressure in each combustion cycle, wherein in said injection time arithmetical operation process, the estimated opening area calculated in said throttle opening area estimation process is used to arithmetically operate an acceleration increase correction value, and said acceleration increase correction value is added to injection time calculated by correcting said basic injection time under various control conditions to arithmetically operate said actual injection time.

9. An engine fuel injection control method for performing a process of estimating an intake air amount from intake pipe pressure and a rotational speed of an engine, and an injection time arithmetical operation process of arithmetically operating an actual injection time based on a basic injection time of fuel determined with respect to the estimated intake air amount, and controlling an injector so as to inject fuel during the actual injection time arithmetically operated in said injection time arithmetical operation process, comprising the steps of:

sampling the intake pipe pressure of said engine at minimal time intervals:

detecting a difference between intake pipe pressure newly sampled and intake pipe pressure sampled last time as an intake pipe pressure change amount;

performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of said engine is regarded as the orifice, wherein an intake pipe pressure increasing period between timing when said intake pipe pressure change amount exceeds a set value and timing when the intake pipe pressure newly sampled reaches a preset estimation permission pressure upper limit value after an intake valve of said engine is closed is determined as said estimation permission period; and performing a process of calculating a minimum value of the estimated opening area calculated in each estimation permission period;

wherein in said injection time arithmetical operation process, an estimated opening area change amount is calculated by subtracting, from the estimated opening area newly calculated, a minimum value of the estimated opening area calculated during the same estimation permission period, said estimated opening area change amount is used to arithmetically operate an acceleration increase correction value when said estimated opening area change amount is positive, and said acceleration increase correction value is added to injection time calculated by correcting said basic injection time under various control conditions to arithmetically operate said actual injection time, every time the estimated opening area is newly calculated during said estimation permission period.

10. The engine fuel injection control method according to claim 8 or 9, wherein said estimated opening area Ao is arithmetically operated based on an arithmetical operation expression $Ao=K\cdot\{(Pb'-Pb)/(Po-Pb)^{1/2}\}$ that expresses a relationship between inlet side pressure of the throttle valve of said engine Po, the intake pipe pressure newly sampled Pb', the intake pipe pressure sampled last time Pb and a constant K, and said estimated opening area Ao.

11. An engine fuel injection control device comprising:

intake air amount estimation means for estimating an intake air amount from intake pipe pressure and a rotational speed of an engine;

injection time arithmetical operation means for arithmetically operating an actual injection time based on a basic injection time of fuel determined with respect to the intake air amount estimated by said intake air amount estimation means; and injector control means for controlling an injector so as to inject fuel during the actual injection time arithmetically operated by said injection time arithmetical operation means, wherein said device further comprises:

intake pipe pressure sampling means for sampling the intake pipe pressure of said engine at minimal time intervals;

intake pipe pressure change amount detection means for detecting a difference between intake pipe pressure newly sampled and intake pipe pressure sampled last time as an intake pipe pressure change amount; and throttle opening area estimation means for performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of said engine is regarded as the orifice, wherein an intake pipe pressure increasing period between timing when said intake pipe pressure change amount exceeds a set value and timing when the intake pipe pressure reaches a preset estimation permission pressure upper limit value after an intake valve of said engine is closed is determined as said estimation permission period, and said injection time arithmetical operation means is comprised so as to use the estimated opening area calculated in said throttle opening area estimation process to arithmetically operate an acceleration increase correction value, and add said acceleration increase correction value to injection time calculated by correcting said basic injection time under various control conditions to arithmetically operate said actual injection time.

12. An engine fuel injection control device comprising:

intake air amount estimation means for estimating an intake air amount from intake pipe pressure and a rotational speed of an engine;

injection time arithmetical operation means for arithmetically operating an actual injection time based on a basic injection time of fuel determined with respect to the intake air amount estimated by said intake air amount estimation means; and injector control means for controlling an injector so as to inject fuel during the actual injection time arithmetically operated by said injection time arithmetical operation means, wherein said device further comprises:

intake pipe pressure sampling means for sampling intake pipe pressure of said engine at minimal time intervals;

intake pipe pressure change amount detection means for detecting a difference between intake pipe pressure newly sampled and intake pipe pressure sampled last time as an intake pipe pressure change amount;

throttle opening area estimation means for performing, during an estimation permission period, a throttle opening area estimation process where an opening area of an orifice is arithmetically operated from a relationship between a mass flow rate of gas and said intake pipe pressure change amount to determine the opening area of said orifice as an estimated opening area of a throttle valve of said engine, the gas flowing through said orifice by a difference in pressure on both sides of said orifice when the throttle valve of said engine is regarded as the orifice, wherein an intake pipe pressure increasing period between timing when said intake pipe pressure change amount exceeds a set value and timing when the intake pipe pressure reaches a preset estimation permission pressure upper limit value after an intake valve of said engine is closed is determined as said estimation permission period, and said injection time arithmetical operation means is comprised so as to perform a process of calculating an estimated opening area change amount by subtracting, from the estimated opening area newly calculated, a minimum value of the estimated opening area calculated during the same estimation permission period, a process of using said estimated opening area change amount to arithmetically operate an acceleration increase correction value when said estimated opening area change amount is positive, and a process of adding said acceleration increase correction value to injection time calculated by correcting said basic injection time under various control conditions to arithmetically operate said actual injection time, every time the estimated opening area is newly calculated during said estimation permission period.

13. The engine fuel injection control device according to claim 11 or 12, wherein said estimated opening area Ao is arithmetically operated based on an arithmetical operation expression $Ao=K\cdot\{(Pb'-Pb)/(Po-Pb)^{1/2}\}$ that expresses a relationship between inlet side pressure of the throttle valve of said engine Po, the intake pipe pressure newly sampled Pb', the intake pipe pressure sampled last time Pb and a constant K, and said estimated opening area Ao.

* * * * *